United States Patent [19]

Letica

[11] Patent Number: 4,711,364

[45] Date of Patent: Dec. 8, 1987

[54] TAMPER-EVIDENT CONTAINER AND CLOSURE

[75] Inventor: Ilija Letica, Oxford, Mich.

[73] Assignee: Letica Corporation, Rochester, Mich.

[21] Appl. No.: 23,541

[22] Filed: Mar. 9, 1987

Related U.S. Application Data

[63] Continuation-in-part of Ser. No. 869,355, Jun. 21, 1986, abandoned.

[51] Int. Cl.[4] ..... B65D 17/40

[52] U.S. Cl. ..... 220/276; 220/270; 220/306; 215/256

[58] Field of Search ..... 220/276, 270, 306, 284; 215/256

[56] References Cited

U.S. PATENT DOCUMENTS

| | | | |
|---|---|---|---|
| 4,024,976 | 5/1977 | Acton | 220/276 |
| 4,111,329 | 9/1978 | Lampman | 220/266 |
| 4,177,930 | 12/1979 | Crisci | 220/284 |
| 4,190,175 | 2/1980 | Allen | 220/270 |
| 4,385,711 | 5/1983 | Bowen | 220/284 |
| 4,476,993 | 10/1984 | Krout | 220/276 |
| 4,487,329 | 12/1984 | Winstead | 220/276 |
| 4,520,942 | 6/1985 | Dwinell | 220/257 |
| 4,602,718 | 7/1986 | Dutt | 220/266 |

*Primary Examiner*—George T. Hall

*Attorney, Agent, or Firm*—Krass & Young

[57] ABSTRACT

A two-level tamper-evident system for molded plastic container closure combinations. The closure is of the type which has an inexpandable peripheral skirt which snaps over and locks onto the container lip and which must be broken at several fracture points before it can be removed. In addition a tear strip acts as a removable barrier to the fracture points. As such, it must be received before the closure can be removed.

18 Claims, 6 Drawing Figures

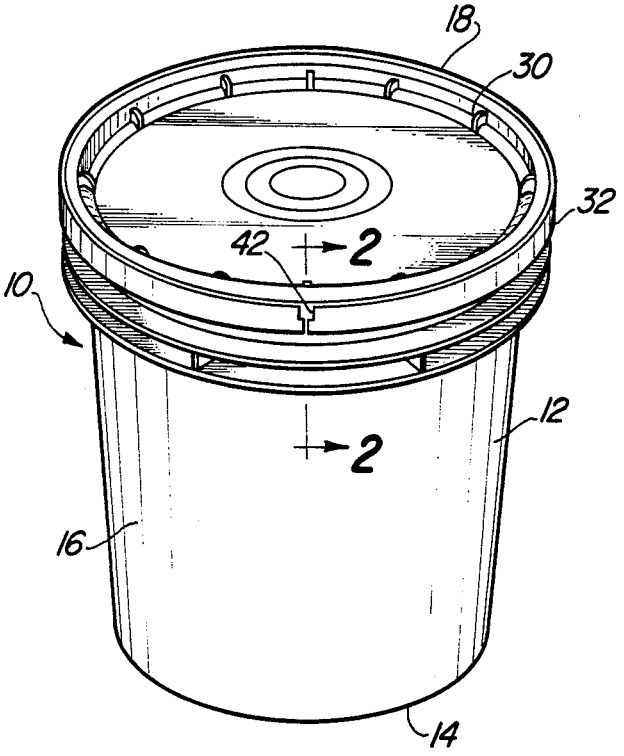
Fig-1
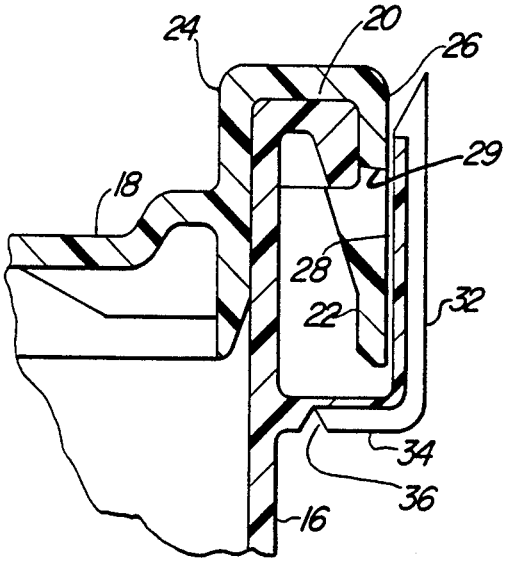
Fig-2
Fig-3
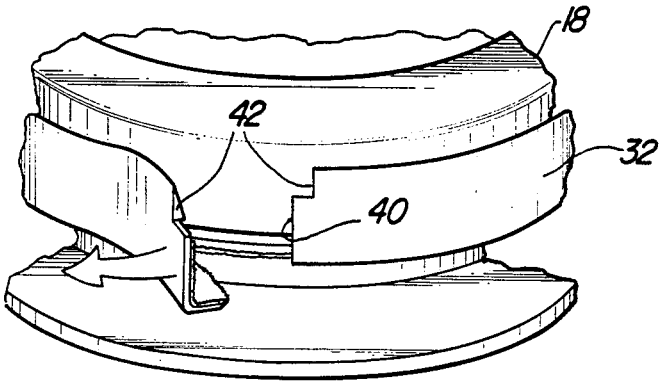

TAMPER-EVIDENT CONTAINER AND CLOSURE

RELATED APPLICATION

This application is a continuation-in-part of Ser. No. 869,355, filed June 21, 1986, now abandoned.

INTRODUCTION

This invention relates to container and closure combinations and, more particularly, to a tamper-evident container and closure combination in which access to the outer skirt of the closure for removal purposes is inhibited by means of a tear strip.

BACKGROUND OF THE INVENTION

It is becoming popular and, in many cases, legally necessary to market food and pharmaceuticals in containers which give physical evidence of tampering; i.e., containers having a frangible section which typically must be broken or disassembled in some significant fashion before they may be opened to provide access to the contents.

Molded plastic containers are among the most popular types of containers for food products and pharmaceuticals and the tamper-evident feature is typically provided by means of a pre-located tear strip which is attached to the closure or container by means of a frangible section. Once the tear strip is removed, one may easily remove and replace the closure.

Examples of tamper-evident closures having frangible and tear strips in both metal and plastic are illustrated by the U.S. Pat. Nos. 4,520,942, 4,487,329 and 4,476,993. U.S. Pat. No. 4,024,976 granted May 24, 1977 to Daniel Acton on an invention entitled "Tamperproof Molded Package" discloses a single level security system wherein a tear strip formed integrally with the container covers just the lower edge of the closure skirt to impede removal of the closure from the container. Once the tear strip is removed, the closure is easily removed by lifting an edge and there is no security at all; i.e., no second tamper-evident function.

SUMMARY OF THE INVENTION

The present invention provides a two-level tamper-evident quality in a container and closure combination and embraces the location of a tear strip on either the closure or on the container. In general, this is accomplished by providing the container with a first security level in the form of a lock-on closure of such construction that it is difficult or impossible to pry the closure from the container unless a generally continuous skirt portion of the closure is fractured into a number of smaller portions. In the preferred form, fracturing of the closure skirt is facilitated by a plurality of apertures is formed therein. A person desiring to remove the closure from the container may insert a tool, such as a knife or screwdriver, into the apertures one-by-one and apply a levering action to fracture the skirt in several pre-determined positions around its periphery, enabling the closure thereafter to be easily removed from the container. The second level of security is provided by a tear strip located either on the container or the closure so as to impede or inhibit access to the closure skirt. Only after the tear strip is removed may one reach the fracture points in the closure skirt or apply such forces as are needed to remove the closure from the container.

In a preferred form,.the container and the closure are made of an injection-moldable plastic such as polyethylene and the closure is of the type which exhibits an inverted U-shaped section at the periphery thereof so as to achieve an interlocking "snap fit" over an outwardly projecting flange or lip on the end of a molded plastic container. The container enclosure may be fabricated in different sizes and shapes that will be apparent to those skilled in the art.

BRIEF DESCRIPTION OF THE DRAWINGS

FIG. 1 is a perspective view of a container and closure assembly embodying the invention with a tear strip formed on the container;

FIG. 2 is a sectional view of the assembly of FIG. 1 illustrating the physical relationship of the closure and container with one another;

FIG. 3 is an enlarged view of a portion of the container and closure assembly of FIG. 1 with the tear strip partially removed;

DETAILED DESCRIPTION OF THE ILLUSTRATIVE EMBODIMENT

Figure 4:
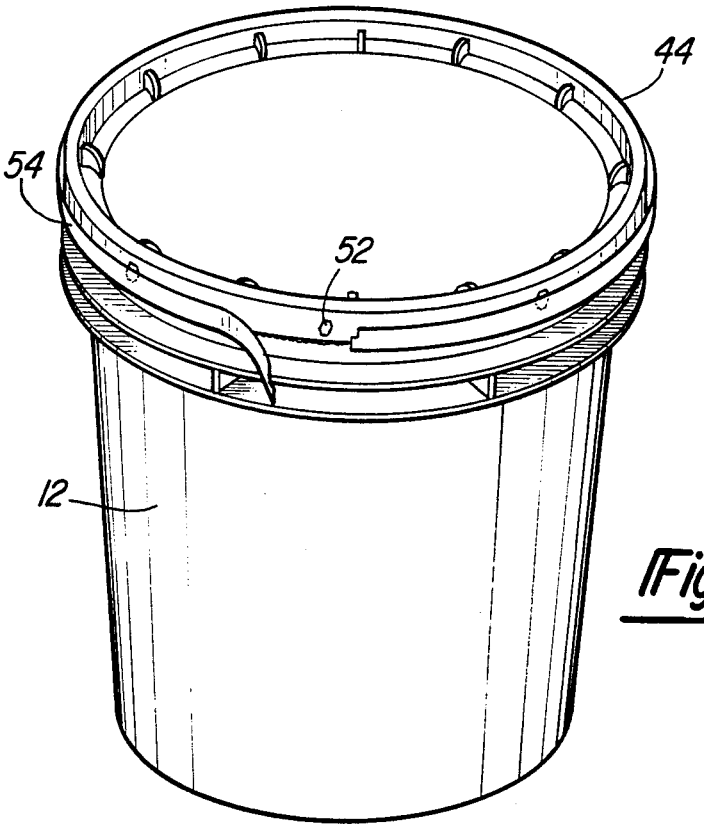
FIG. 4 is a second embodiment of the invention showing a sectioned view of a closure having a tear strip formed thereof.

Referring to the drawing, FIGS. 1–3 illustrate a container assembly 10 comprising a substantially cylindrical but slightly tapered container 12 having a recessed circular bottom 14 and a side wall 16 which is integral with the bottom 14 and which extends toward an upper, open end. The assembly 10 further comprises a closure 18 of the type which snaps onto the container 12 in an interfitting relationship hereinafter described in detail.

Both the container 12 and the closure 18 are preferably injection molded from a suitable plastic material such as polyethylene. Wall thickness and rigidity may be varied according to the size and intended application of the assembly 10 as will be apparent to those skilled in the art. However, the embodiment which is disclosed herein contemplates a fairly rugged construction and substantially rigidity for use in a variety of industrial applications including the transportion of foodstuffs in bulk quantities.

The side wall 16 of container 12 terminates in a peripheral seat 20 which is relatively flat and which extends outwardly into a depending annular flange 22. Closure 18 is of the type which exhibits an inverted U-shaped section 24 which fits over and on the seat 20 and which further exhibits a depending annular skirt portion 26 having a locking flange 28 which snaps under the flange 22 of the container 12 to firmly and securely hold the closure 18 to the container 12 after application. In the assembled form shown in FIGS. 1 and 2, the skirt 26 lies parallel to but is radially outwardly spaced from the container side wall 16.

A number of fracture points 29 are provided around the skirt 26 so that it may be cut or broken to increase its pivotal flexibility relative to the top portion of the U-shaped section 24 thereby to facilitate reapplication and removal of the closure 18 from the container 12 after it has been first opened. Means such as molded ribs 30 may be added to the closure 18 to add stiffness as desired. In the preferred embodiments of FIGS. 1–4, fracture points 29 are in the form of apertures extending through skirt 26, but it is to be understood that fracture points 29 may take a variety of forms and that the preferred embodiments are not intended to be limiting. For example, fracture points 29 could take the form of grooves, perforations, etc.

To remove the closure 18 from the container 12, it is typically necessary to gain physical access to the fracture points 29 of the skirt 26 such as by inserting an appropriate tool into points 29 and between the skirt 26 and side wall 16 and then manipulating the tool to rupture or cut the material of the closure adjacent and below each of the fracture points 29 sufficiently to cut or break skirt 26 into several circumferential segments so as to be able to easily lift the closure 18 from the container.

In accordance with the invention of FIGS. 1–3, the first level of tamper-evident quality of the relationship between the closure 18 and the container 12 is provided by means of a peripheral tear strip 32 which is integrally attached to the container side wall 16 by means of a radial flange 34 having a frangible portion formed by a V-shaped groove 36. The groove permits the entire tear strip 32 to be physically removed from the container 16 thereby to provide access to the skirt portion 26 of the closure 18 to remove it from the container 12.

To initiate the tearing of the tear strip 32 from the side wall 16 by way of the frangible section formed by groove 36, a "starter" point is provided by means of a vertical perforation 40 terminating at the upper extremity in a notch 42 which permits the user to insert his fingers or a suitable tool into the notch 42, tear the perforation 40 downwardly and inwardly to the V-shaped groove 36 and thereafter remove the entire tear strip 32 from the container.

The tear strip 32, when integral with the side wall 16 and in place as shown in FIGS. 1 and 2, makes it impossible to gain sufficient access to the apertures 29 in skirt 26 to remove it from the container 12 without creating physical damage which is in itself evidence of tampering. The closure 18 is so constructed that it is impossible to obtain a sufficient grasp or leverage to remove it from the container 12 with the tear strip 32 in place; i.e., the closure 18 is quite rigid and inflexible and offers little in the way of external detail where a tool might be applied.

On the other hand, it is relatively easy to open the tear strip 32 at the perforation 40 and remove it from the container. Once the tear strip 32 is removed, one may then access the fracture points 29 to the closure skirt 26 into segments so that it may be removed. Accordingly, two levels of security are provided.

Figure 5:
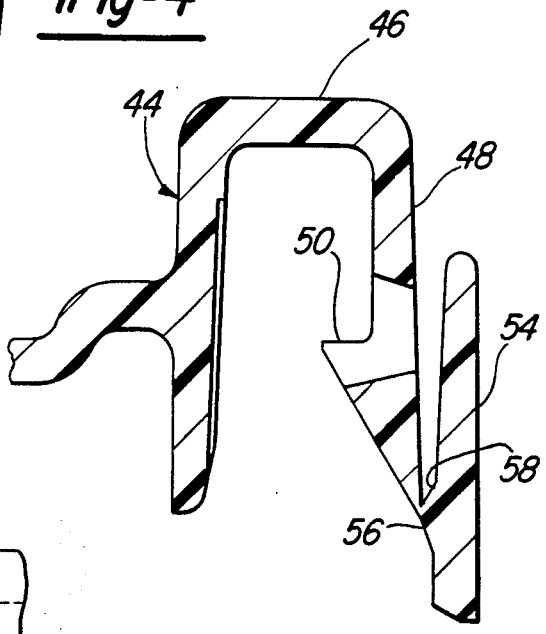
Figure 6:
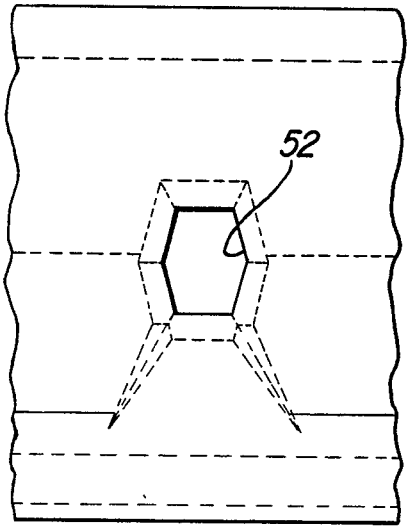

In a second embodiment shown in FIGS. 4–6, a closure 44 has an inverted U-shaped section 46 which fits over and on seat 20 of the container 12 in the fashion of the first embodiment. Closure 44 exhibits a depending annular skirt portion 48 having discontinuous locking flange portions 50 which snap under flange 22 of container 12 to firmly and securely hold closure 18 to container 12 after application. As with the embodiment of FIGS. 1–3, a number of fracture points 52 are provided around skirt 26 so that it may be cut or broken to increase its pivotal flexibility relative to the top portion of the U-shaped section 46 thereby to facilitate reapplication and removal of the closure 44 from the container 12 after it has been first opened. Flange portions 50 are interrupted by fracture points 52 so that rather than having to split both the wall of the skirt 48 and the much thicker flange portion to remove closure 44 from container 12, only the relatively thin wall of skirt 48 needs to be fractured.

Peripheral tear strip 54 is integrally attached to the bottom edge of skirt 48 by means of a radial flange 56 having a frangible portion formed by a V-shaped groove 58. The groove 58 permits the entire tear strip 54 to be physically removed from closure 44, providing access to skirt portion 48 of closure 44. Tear strip 54 is removed in the same manner as previously described before tear strip 32 in FIGS. 1–3.

As can be seen in FIGS. 2 and 5, tear strips 32 and 54 extend upwardly enough to completely cover fracture points 29 and 52, thereby providing a 2-stage tamper-evident system; i.e., to remove closure 18 and 44 from the container 12, it is necessary to first tear away tear-strips 32 and 54, which in itself is evidence of tampering, and then skirt or the closure must be fractured in several places around its periphery.

Although the illustrative embodiments have been described with reference to a tapered substantially cylindrical container, it is to be understood that the container may be straight-sided in the manner of the inventor's previous U.S. Pat. Nos. 4,293,080, 4,349,111 and 4,429,805. In addition, the cross section of the container may be rectangular, square, oval or of such other shape that the end user may desire.

I claim:

1. A container/closure combination comprising:

a container comprising a bottom and at least one side wall joined to the bottom and terminating in a peripheral seat defining an open end spaced from said bottom;

a closure for said container having an inverted generally U-shaped peripheral section which fits interlockingly over the peripheral seat of the container and includes a skirt portion which, when the closure is in place on said container, lies outside of said side wall;

means formed in said skirt portion to define at least one fracture point for splitting said skirt portion to facilitate removal thereof from the container;

said container/closure combination further comprising a tear strip removably attached thereto so as to cover and prevent access to the fracture point when said closure is in place on said container seat.

2. Apparatus as defined in claim 1 wherein said tear strip is attached to said container adjacent but spaced from said open end.

3. Apparatus as defined in claim 1 wherein said tear strip is attached to said closure skirt.

4. Apparatus as defined in claim 2 wherein said tear strip includes a frangible section to facilitate removal thereof from said side wall.

5. Apparatus as defined in claim 3 wherein said tear strip includes a frangible section to facilitate removal thereof from said skirt.

6. Apparatus as defined in claim 4 wherein said frangible section extends peripherally around said tear strip adjacent said side wall.

7. Apparatus as defined in claim 5 wherein said frangible section extends peripherally around said tear strip adjacent said skirt.

8. Apparatus as defined in claim 3 further including a split section in said tear strip to initiate separation thereof from said side wall by way of said frangible section.

9. Apparatus as defined in claim 4 further including a split section in said tear strip to initiate separation thereof from said skirt by way of said frangible section.

10. Apparatus as defined in claim 3 wherein said seat and said tear strip are substantially peripherally continuous around said container.

11. Apparatus as defined in claim 4 wherein said skirt and said tear strip are substantially peripherally continuous around said closure.

12. Apparatus as defined in clain 10 wherein said container is substantially cylindrical and said seat is substantially circular.

13. Apparatus as defined in claim 11 wherein said closure is substantially cylindrical and said seat is substantially circular.

14. Apparatus as defined in claim 1 wherein said container/closure combination and tear strip are plastic.

15. Apparatus as defined in claim 14 wherein said tear strip is attached to said container by being molded integrally therewith.

16. Apparatus as defined in claim 14 wherein said tear strip is attached to said closure by being molded integrally therewith.

17. Apparatus as defined in claim 1 wherein said skirt portion has integrally formed thereon a peripherally continuous flange portion adjacent said U-shaped peripheral section and projectioning a substantial distance therein so as to frictionally engage said peripheral seat.

18. Apparatus as defined in claim 17 wherein said inwardly projecting flange portion comprises a plurality of flange portions positioned around the periphery of said skirt below and between said apertures.

* * * * *